US006244923B1

(12) United States Patent
Komaba

(10) Patent No.: US 6,244,923 B1
(45) Date of Patent: Jun. 12, 2001

(54) BALLOON AND A METHOD FOR MANUFACTURING THE BALLOON

(76) Inventor: Kunio Komaba, 2-2-5 Morishita, Koutou-ku (JP), 135-0004

( * ) Notice: Subject to any disclaimer, the term of this patent is extended or adjusted under 35 U.S.C. 154(b) by 0 days.

(21) Appl. No.: 09/114,320

(22) Filed: Jul. 13, 1998

(30) Foreign Application Priority Data

Jun. 12, 1998 (JP) ..... 10-165179
Jul. 7, 1998 (JP) ..... 10-192164

(51) Int. Cl.[7] ..... A63H 3/06
(52) U.S. Cl. ..... 446/224; 446/220; 446/226
(58) Field of Search ..... 446/220, 224, 446/225, 226

(56) References Cited

U.S. PATENT DOCUMENTS 1,245,444 * 11/1917 Creque ..... 446/224
5,188,558 * 2/1993 Barton et al. ..... 446/224
5,295,892 * 3/1994 Felton ..... 446/224
5,547,413 * 8/1996 Murray ..... 446/220
5,595,521 * 1/1997 Becker ..... 446/224
5,769,683 * 6/1998 Park ..... 446/220
5,830,780 * 11/1998 Dennison et al. ..... 446/220 X
5,860,441 * 1/1999 Garcia ..... 446/224 X
5,893,790 * 4/1999 Montgomery ..... 446/220

* cited by examiner

*Primary Examiner*—John A. Ricci
(74) *Attorney, Agent, or Firm*—Pennie & Edmonds LLP

(57) ABSTRACT

A balloon including a balloon body composed of two sheets made of synthetic resin, a thin film-like nonreturn valve provided between the sheets, and a string made of synthetic resin; wherein the sheets and the thin film-like nonreturn valve are melt-bonded together, and the string is integrally connected to the balloon body or the nonreturn valve when the sheets and/or the thin film-like nonreturn valve are melt-bonded together.

11 Claims, 8 Drawing Sheets

BALLOON AND A METHOD FOR MANUFACTURING THE BALLOON

BACKGROUND OF THE INVENTION

1. Field of the Invention

The present invention relates to a balloon, and more particularly relates to a balloon having a string for holding the balloon and which is integrally attached to it. The present invention also relates to a method for manufacturing the balloon.

2. Prior Art

Balloons, whose body is composed of two sheets made of synthetic resin and melt-bonded together at the peripheral portion, are generally well known, in addition to balloons made of rubber. In such balloons, both the outside and inside surfaces of the balloon body are metalized by Aluminum so that the Helium gas in the balloons is not apt to leak, and thus people can enjoy the inflated condition of the balloons for a long time.

In such balloons where both surfaces are metalized by Aluminum they have a high electric conductivity and thus radio waves are easily reflected by the surfaces of the balloons. Therefore, if the balloon flies in the sky and is caught by an electric wire, problems may occur such that the electric wire is shorted by the balloon, or if the balloon floats near an airport, the radar would be influenced by the balloon and then a flight of airplanes could be hindered. Such a balloon floating in the sky really gives trouble to electric power supply companies or radar systems at airports. Therefore, it is required for balloon manufacturers to consider a counter-plan so as not to allow the balloons to fly off freely. There is a duty therefore imposed to provide a string and a weight to such balloons.

However, the string, hitherto, provided for the balloons does so only by an adhering tape as shown in FIG. 1, where one end of the string 21 is fixed to the surface of the balloon 20 by means of an adhering tape 22, after the balloon body 20 has been assembled. Therefore, the work for fixing the string 21 to the surface of the balloon body 20 after the balloon body 20 has been assembled causes trouble and takes much time to do. Further, since the string 21 is attached to one of the side surfaces of the balloon body 20, it is difficult to keep the posture of the balloon upright while the balloon is inflated and floated. Such an inclined posture is not good for balloons because the balloons have characters printed on the surface thereof or the shape of the balloon body per se has been shaped.

The present invention has for its purpose to provide balloons that have a string for tightly holding the balloon but also be able to easily keep its posture upright and a method for manufacturing balloons by which the string can be easily and strongly attached to the balloons keeping their posture upright.

SUMMARY OF THE INVENTION

In order to solve the above-mentioned task, the present invention has its purpose to provide a balloon which comprises a balloon body composed of a plurality of sheets, a thin film-like nonreturn valve provided between two out of said plurality of sheets for providing an opening to introducing a gas into the balloon body, and a string for holding said balloon; wherein said string is attached to said balloon body being held between two out of said plurality of sheets or said string is attached to said thin film-like nonreturn valve.

Preferably, the string has a weight at the free end thereof. Further, it is preferred that the sheets constituting of the balloon body, the thin-film nonreturn valve and the string are made of synthetic resin. It may be possible to arrange such that the string is attached to the balloon body being separated from the nonreturn valve.

The present invention also has a purpose to provide a method for manufacturing balloons composed of a plurality of sheets which comprises steps of: superimposing two of said plurality of sheets for use in forming a balloon body; providing a thin film-like nonreturn valve between said sheets; superimposing a string with said sheets and/or said nonreturn valve; and conducting a melt-bonding process to integrally melt-bond up said sheets, said nonreturn valve and said string together.

Preferably the balloon body is cut off from the sheets by said melt-bonding process so as to form an outer shape of said balloon body.

Furthermore, it is preferred that the materials for the sheets, for the valve and for the string have a feature to be melted at almost the same temperature.

The present invention has another purpose to provide a method for manufacturing balloons which comprises steps of: preparing a balloon body composed of a plurality of sheets which are melt-bonded together but leaving an opening; inserting thin film-like nonreturn valve into said opening; attaching a string for holding the balloon to the balloon body or the nonreturn valve; and conducting a melt-bonding process to integrally melt-bond up said balloon body and thin film-like nonreturn valve.

It may be possible to arrange such that the string is melt-bonded between two of said plurality of sheets constituting of the balloon body so as to be separated from the nonreturn valve when the balloon body is prepared.

It may also be possible to arrange such that the string has been attached to the nonreturn valve preliminarily or the string is melt-bonded between the nonreturn valve and the balloon body when the heat melt-bonding procedure is conducted.

Furthermore, it is preferred to have a feature that the materials for the sheets, for the valve and for the string are melted at almost the same temperature.

It may be possible to modify the method such that said string is inserted into the inside of the thin film-like nonreturn valve after melt-bonding said thin film-like nonreturn valve to the inside of said opening of the balloon body and then said string is melt-bonded to said thin film-like nonreturn valve.

DETAILED EXPLANATION FOR PREFERRED EMBODIMENTS

Figure 1:
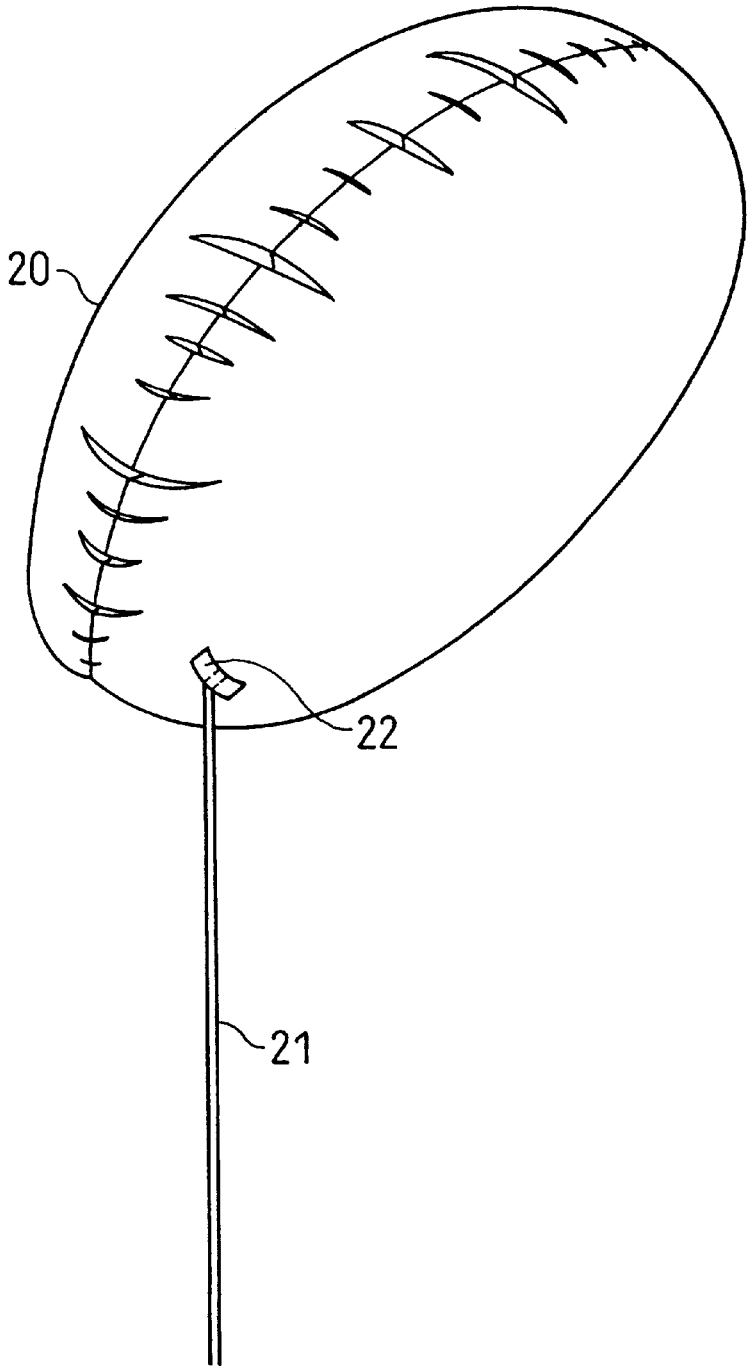
Fig. 1 Prior Art
FIG. 1 is a perspective view showing a structure of a conventional balloon which has a string.
Figure 2:
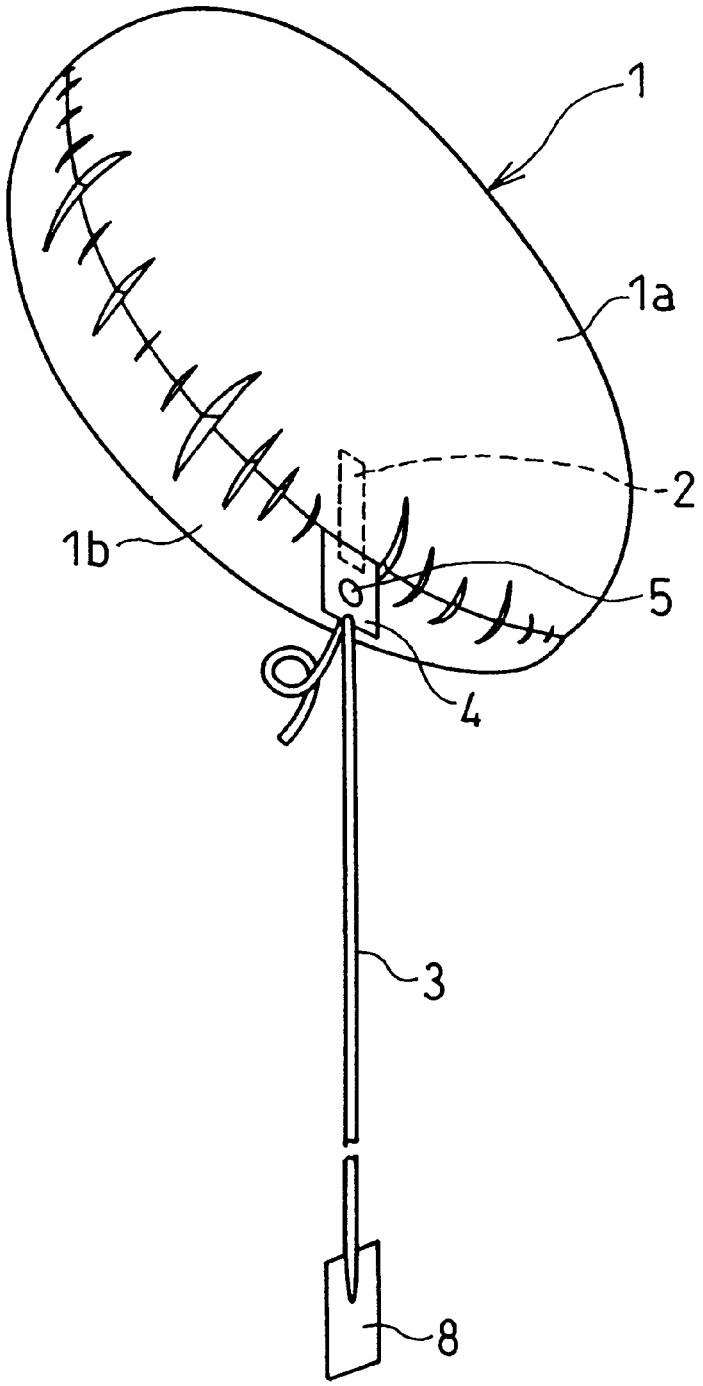
FIG. 2 is a perspective view depicting a first embodiment of a balloon having a string for holding the balloon according to the present invention.

FIG. 2 shows a construction of a balloon according to the present invention, which comprises a balloon body, a thin film-like nonreturn valve 2 and a string 3; the balloon body 1 is composed of two round-shaped sheets 1*a* and 1*b* made of synthetic resin which are melt-bonded together. The nonreturn valve 2 and the string 3 are provided between sheets 1*a* and 1*b* so as to be integral together with the balloon body 1.

The balloon body 1 is manufactured such that the sheets 1*a* and 1*b* are superimposed and melt-bonded together at their peripheral portion. The front and rear surfaces of both the sheets 1*a* and 1*b* are metalized with Aluminum. Both the sheets 1*a,* 1*b* have a shape of substantially round but they also have a protruded portion 4 as shown in FIG. 2; and the thin film-like nonreturn valve 2 is provided inside of the protruded portion 4. Further, on the protruded portion 4 of the sheet 1*a,* is formed an opening 5 for inserting a nozzle, which is used for inflating the balloon with Helium gas. It should be noted that the peripheral portion of the protruded portion 4 is also melt-bonded together. The numerical reference 8 denotes a weight for preventing the balloon to float free in the sky, which is provided at a free end of the string 3.

Figure 3:
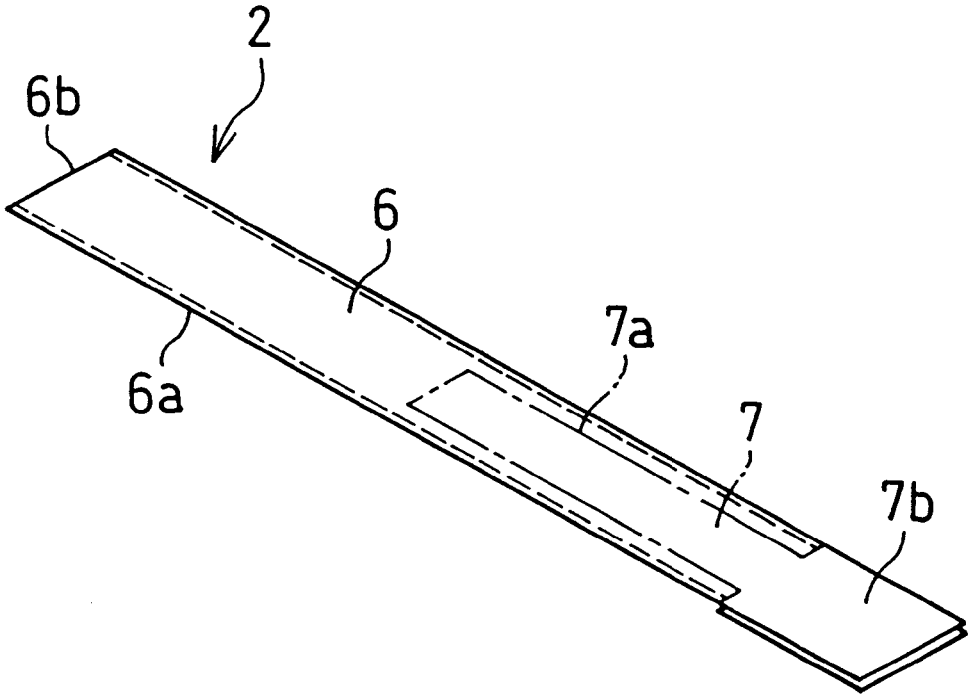
FIG. 3 is a perspective view illustrating a thin film-like nonreturn valve which can preferably be used for balloons according to the present invention.

FIG. 3 depicts a construction of the thin film-like nonreturn valve 2. The valve 2 comprises two pieces of belt-like film 6, which are made of synthetic resin, being superimposed together. On the inside surface of one of the film pieces 6, there is printed heat-resistant ink so as to form a shape 7 as shown by broken line 7*a* in FIG. 3; and the film pieces 6 are melt-bonded together at both longitudinal sides thereof as illustrated by broken line 6*a* in FIG. 3. When the sheets 1*a* and 1*b* consisting of the balloon body 1 are melt-bonded together while holding the film pieces 6 of the valve so as to traverse the heat-resistant ink printed portion 7, the printed portion 7 is not attached to the opposite film 6 because of the existence of the heat resistant ink there. As a result, an opening 7*b* is formed on one end of the nonreturn valve 2, which serves for introducing Helium gas into the balloon body 1. It should be noted that the other end 6*b* of the valve 2 is also open.

As shown in FIG. 2, the sheets 1*a* and 1*b* of the balloon body 1 are melt-bonded together at their peripheral portions, and the thin film-like nonreturn valve 2 and the string 3 are integrally held between the sheets 1*a* and 1*b*.

The string 3 is also made of synthetic resin. A curled ribbon for use in wrapping purposes can be preferably used. According to the first embodiment, one of the ends of the ribbon is folded to be turned and the folded portion is melt-bonded to the balloon body 1, while making the other end of the turned string free. The free end of the ribbon may be curled up to improve the ornamental effect of the balloon. It is preferred to preliminarily provide the weight 8 to the other free end of the ribbon 3. The material or the shape of the weight 8 is not limited but it must be heavier than the buoyancy of the balloon body 1.

In order to inflate the balloon body 1, a gas-blowing nozzle (not shown) is inserted into the valve 7 via an opening 5 formed in the protruded portion 4 of the sheet 1*a*. When Helium gas is blown into the balloon body 1, the opening 6*b* and 7*b* at both ends of the thin film-like nonreturn valve 2 is opened by a blowing pressure of the Helium gas and the balloon is inflated with the Helium gas. After the balloon is inflated with the gas, the nonreturn valve 2 is closed by the pressure of the gas so that a backlash of the gas is prevented.

Figure 4:
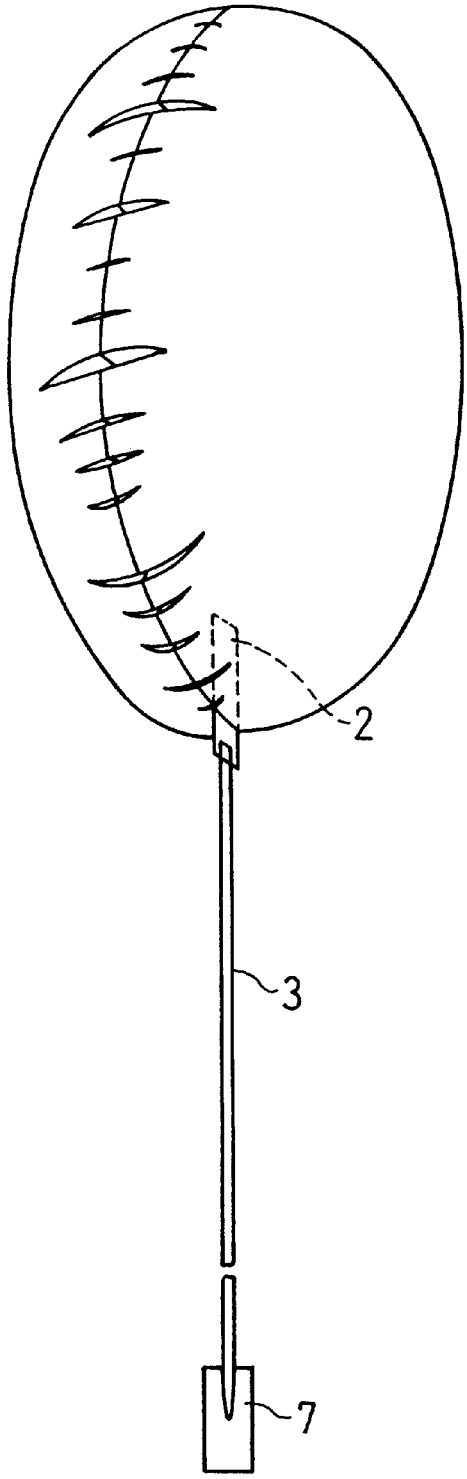
FIG. 4 is a perspective view representing a second embodiment of a balloon having a string for holding the balloon according to the present invention.

FIG. 4 shows a construction of the second embodiment of the balloon according to the present invention. It is not necessary to hide the nonreturn valve 2 inside the protruded portion 4 of the balloon body 1, so that it may be arranged, for instance, such that the balloon body 1 has no protrusion 4 and apart of the thin film-like nonreturn valve 2 appears outside of the balloon body for introducing the gas into the balloon body 1 as shown in FIG. 4. In this case, the nozzle (not shown) should be inserted directly into the thin film-like nonreturn valve 2 when filling the balloon body 1 with gas. In this case, the string 3 may have been preliminarily attached to the nonreturn valve 2 when the pieces of the film 6 of the valve are melt-bonded together to manufacture the nonreturn valve 2; or it may be possible to attach the string 3 between the balloon body 1 and the nonreturn valve 2 when the nonreturn valve 2 is melt-bonded to the balloon body 1.

Figure 5:
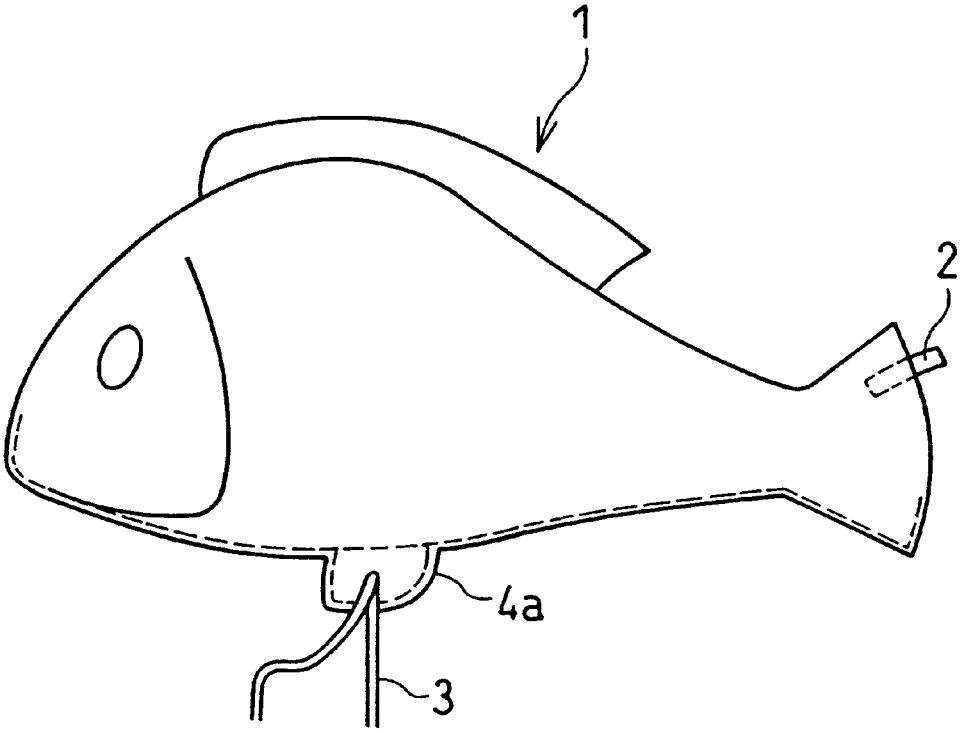
FIG. 5 is a side view showing a third embodiment of a balloon having a string for holding the balloon according to the present invention.

FIG. 5 illustrates a construction of the third embodiment of the balloon according to the present invention. It should be noted that it is not an essential requirement to connect the string 3 near or to the nonreturn valve 2. Instead of this, it may be possible to connect the string 3 to some other lace of the peripheral portion 4*a* of the balloon body 1 being separated from the nonreturn valve 2, as illustrated in FIG. 5. In this case, the string 3 is melt-bonded so as to be held between the sheets 1*a* and 1*b* when these sheets are melt-bonded together.

There are two methods for manufacturing balloons according to the present invention which will be explained below. One of the methods is that the thin film-like nonreturn valve 2 and the string 3 are melt-bonded to the balloon body 1 at the same time when the balloon body is assembled (shown in FIG. 6), and another one of the methods is that the balloon body 1 is assembled first and then attach the thin film-like nonreturn valve 2 and the string 3 to the assembled balloon body 1 afterward (shown in FIG. 7). The balloon shown in FIG. 2 is manufactured by using the former method and the balloon illustrated in FIG. 4 is by the latter method.

Figure 6A:
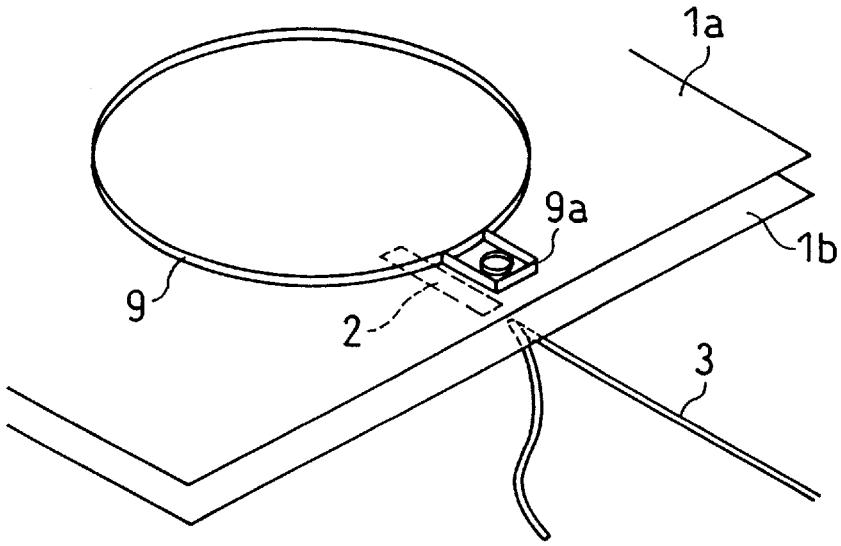
FIGS. 6(*a*) and (*b*) are perspective views depicting steps for manufacturing a balloon having a string which is shown in FIG. 2.
Figure 6B:
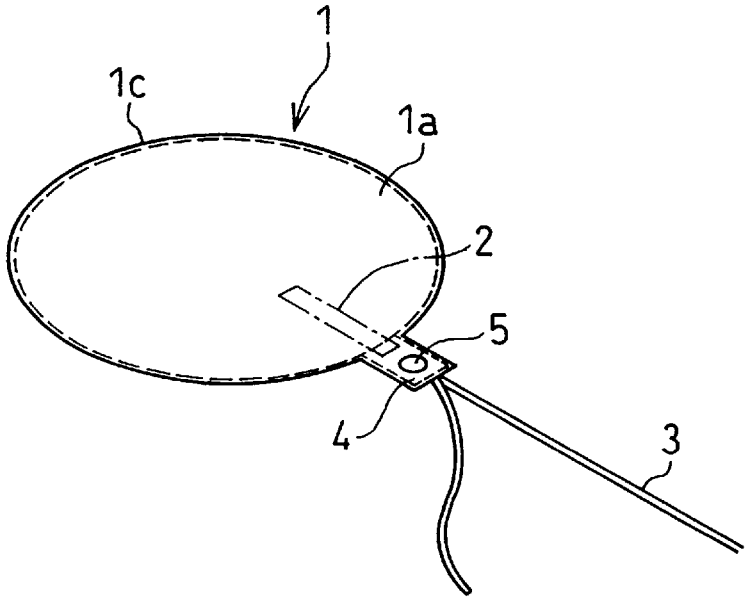

FIGS. 6(*a*) and 6(*b*) show the steps for manufacturing the balloon according to the former method mentioned above. As shown in FIG. 6(*a*), two sheets made of synthetic resin 1*a* and 1*b* are superimposed together for making a balloon body 1. A thin film-like nonreturn valve 2 is arranged between these sheets 1*a* and 1*b* and a string 3 is put under the sheet 1*b,* which is arranged at a lower side. Then melt-bonding is conducted with the aid of a melt-bonding device 9 which has an almost round shape but provided a protruded portion 9*a*. After the melt-bonding is conducted, the shape of the balloon body 1 is cut out from the sheets 1*a* and 1*b* and the thin film-like nonreturn valve 2 and the string 3 are integrally connected together so as to form the balloon as shown in FIG. 6(*b*), which has not been inflated yet. In FIG. 6(*b*), the melt-bonding has been conducted along the broken line 1*c*.

It should be noted that the materials for the balloon body 1, for the thin film-like nonreturn valve 2, and for the string 3 should be selected so as to be melt at almost the same temperature.

Figure 7A:
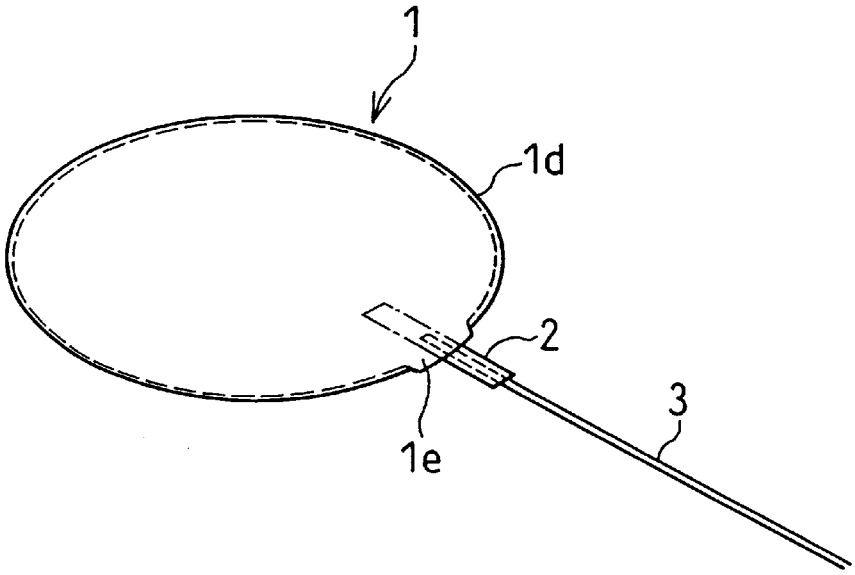
FIGS. 7(*a*) and (*b*) are perspective views illustrating steps for manufacturing a balloon having a string which is shown in FIG. 4.
Figure 7B:
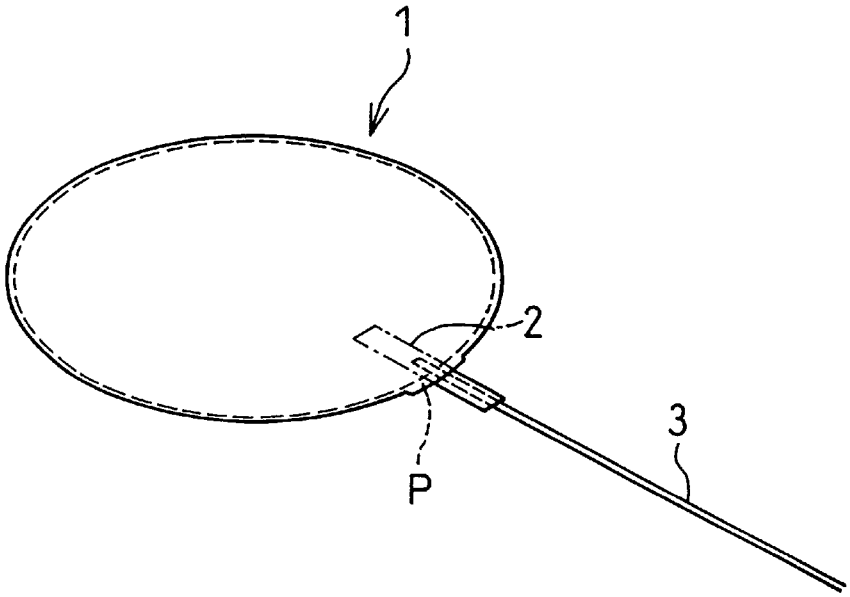

FIGS. 7(*a*) and 7(*b*) illustrate the steps to manufacture the balloon according to the latter method mentioned above.

Balloon body 1 consisted of two sheets 1*a* and 1*b* are preliminarily prepared by conducting a melt-bonding along the broken line 1*d*. The sheets are melt-bonded together at their peripheral portion but leaving an opening 1*e* there. As illustrated in FIG. 7(*a*), a string 3 is inserted into a thin film-like nonreturn valve 2. After making the balloon body 1, the valve 2 with the string 3 is inserted into the opening 1*e* at the peripheral portion of the balloon body 1. Then, as shown in FIG. 7(*b*), the opening 1*e* of the balloon body 1 is melt-bonded along the broken line P, while holding the thin film-like nonreturn valve 2 inside of the opening 1*e*. According to this method, at the same time when the opening 1*e* is melt-bonded, the string 3 is also melt-bonded to the inside of the thin film-like nonreturn valve 2.

Figure 8:
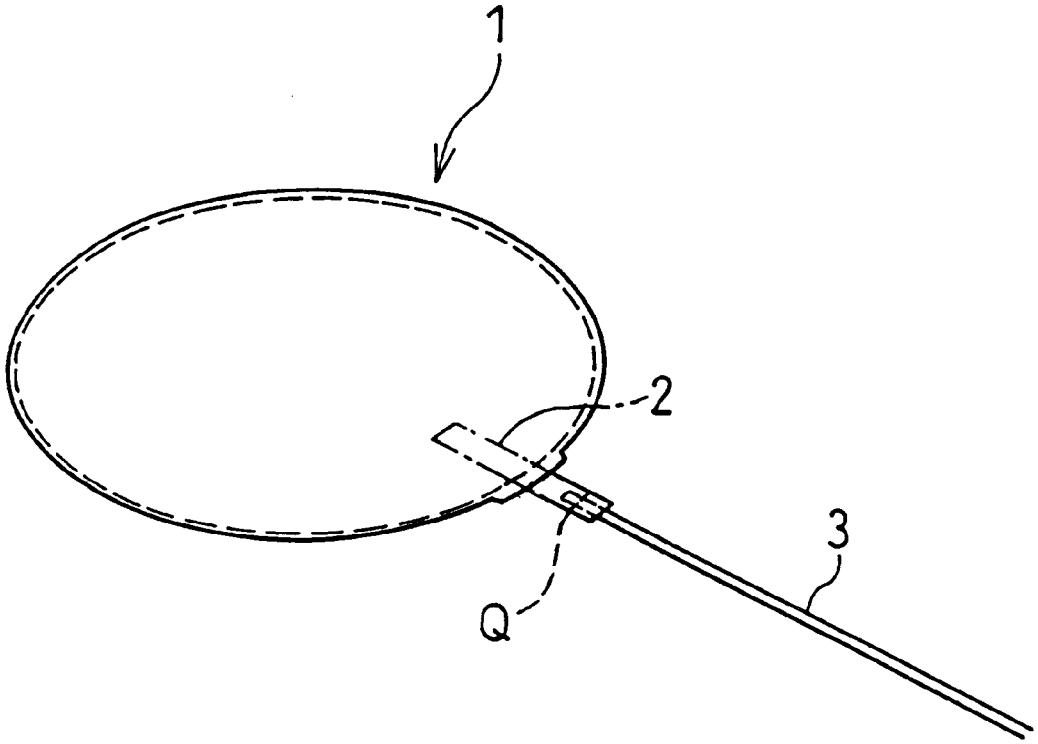
FIG. 8 is a perspective view showing another embodiment of a balloon having a string for holding the balloon according to the present invention.

In this case, it may be possible to arrange such that the thin film-like nonreturn valve 2 and the string 3 are preliminarily melt-bonded together and then the valve 2 with the string 3, which has already been melt-bonded to the valve 2, is melt-bonded to the balloon body 1. Further, as shown in FIG. 8, it may also be possible to arrange such that the thin film-like nonreturn valve 2 is melt-bonded to the opening 1*e* of the balloon body 1 first, and then the string 3 is melt-bonded to the free end portion of the nonreturn valve 2, which is protruded from the balloon body 1. In this case, the melt-bonding for attaching the string 3 to the nonreturn valve 2 is conducted along the line Q in FIG. 8. It should be noted that it may be possible to attach the string 3 on the outer surface of the valve 2 or between the pieces constituting of the valve 2.

In case that the string 3 is melt-bonded between the sheets 1*a*, 1*b* being separated from the nonreturn valve 2, the string 3 should be melt-bonded between the sheets 1*a* and 1*b* when the balloon body 1 is manufactured; and then the nonreturn valve 2 is provided between the sheets 1*a* and 1*b* in an appropriate place in accordance with either methods shown in FIGS. 6 or 7.

In the embodiments explained above, the balloon body 1 consists of two sheets 1*a* and 1*b*. However, for three-dimensional shaped balloons or larger sized balloons, three or more sheets are connected together to assemble the balloon body. The present invention can be also applied to manufacture such types of balloons.

It should be noted polyethylene or polypropylene is preferably used for the material of the balloon body, the nonreturn valve and the string. It is required that at least the portions to be connected are made of synthetic resin. Therefore, the present invention can be also applied to balloons, for example, where the balloon body is made of paper and on the inner surface of which is laminated with synthetic resin.

As explained above, according to the invention, the string 3 can integrally be attached to the balloon by melt-bonding at the same time when the balloon is manufactured. Therefore, it becomes possible to pass the conventional step to attach the string to the balloon after the balloon has been assembled and thus the cost for manufacturing balloons can be reduced.

Further, according to the invention, it is possible to float the balloon body in the air keeping its posture symmetric about the point at which the string 3 is attached. That is to say, the balloon can always keep its posture perpendicularly without being inclined. Furthermore, according to the invention, since the string 3 is connected to the balloon by a melt-bonding process, the string 3 is held on the balloon more strongly in comparison to the prior technique. Therefore, such an accident can be effectively prevented that the balloon becomes free from the string and is caught by an electric wire or interferes with radar when the balloon flies out in the sky.

What is claimed is:

1. A balloon comprising:

a balloon body composed of a plurality of sheets, a thin film-like nonreturn valve disposed between said sheets for introducing a gas into the balloon body, and a string for holding said balloon;

wherein said string is attached interior of the balloon body.

2. A balloon according to claim 1, wherein said string is attached between two of said plurality of sheets.

3. A balloon according to claim 2 further comprising a weight at a free end of said string.

4. A balloon according to claim 2, wherein said plurality of sheets, said thin film-like nonreturn valve and said string are made of synthetic resin.

5. A balloon according to claim 1, wherein said string is attached between said nonreturn valve and one of said plurality of sheets.

6. A balloon according to claim 5 further comprising a weight at a free end of said string.

7. A balloon according to claim 5, wherein said plurality of sheets, said thin film-like nonreturn valve and said string are made of synthetic resin.

8. A balloon according to claim 1, wherein said string is attached to said nonreturn valve.

9. A balloon according to claim 8, wherein said thin film-like nonreturn valve is composed of two film sheets and said string is attached between the two film sheets.

10. A balloon according to claim 8 further comprising a weight at a free end of said string.

11. A balloon according to claim 8, wherein said plurality of sheets, said thin film-like nonreturn valve and said string are made of synthetic resin.

* * * * *